US009728129B2

(12) United States Patent
Lee et al.

(10) Patent No.: US 9,728,129 B2
(45) Date of Patent: Aug. 8, 2017

(54) DISPLAY DEVICE AND THE METHOD FOR DRIVING THE SAME

(71) Applicant: LG Display Co., Ltd., Seoul (KR)

(72) Inventors: ShinWoo Lee, Incheon (KR); Jaehwan Yun, Seongnam-si (KR)

(73) Assignee: LG Display Co., Ltd., Seoul (KR)

( * ) Notice: Subject to any disclaimer, the term of this patent is extended or adjusted under 35 U.S.C. 154(b) by 37 days.

(21) Appl. No.: 14/840,948

(22) Filed: Aug. 31, 2015

(65) Prior Publication Data

US 2016/0117988 A1 Apr. 28, 2016

(30) Foreign Application Priority Data

Oct. 23, 2014 (KR) ..... 10-2014-0144129

(51) Int. Cl.
*G09G 3/3233* (2016.01)

(52) U.S. Cl.
CPC ... *G09G 3/3233* (2013.01); *G09G 2300/0426* (2013.01); *G09G 2300/0819* (2013.01); *G09G 2300/0842* (2013.01); *G09G 2300/0861* (2013.01); *G09G 2320/029* (2013.01); *G09G 2320/0219* (2013.01); *G09G 2320/0693* (2013.01); *G09G 2330/02* (2013.01)

(58) Field of Classification Search
CPC ..... G09G 2300/0426; G09G 3/3258; G09G 3/3696
See application file for complete search history.

(56) References Cited

U.S. PATENT DOCUMENTS 8,063,857 B2 * 11/2011 Kohno ..... G09G 3/3233 315/169.3
9,093,571 B2 * 7/2015 Osame ..... G09G 3/3258
2006/0082528 A1 * 4/2006 Guo ..... G09G 3/3233 345/82
2006/0145995 A1 * 7/2006 Kim ..... G09G 3/3655 345/98
2010/0053056 A1 * 3/2010 Lee ..... G02F 1/1345 345/94
2010/0201669 A1 * 8/2010 Kim ..... G09G 3/3648 345/211
2012/0162184 A1 * 6/2012 Kim ..... G09G 3/3655 345/212
2013/0328750 A1 * 12/2013 Moh ..... G09G 3/3655 345/58

* cited by examiner

*Primary Examiner* — Andrew Sasinowski
*Assistant Examiner* — Chun-Nan Lin
(74) *Attorney, Agent, or Firm* — Fenwick & West LLP

(57) ABSTRACT

The present disclosure provides a display device and a method for driving the same, which reduce or prevent a common voltage distortion phenomenon caused by a coupling phenomenon and thereby improve image quality.

10 Claims, 16 Drawing Sheets

DISPLAY DEVICE AND THE METHOD FOR DRIVING THE SAME

CROSS-REFERENCE TO RELATED APPLICATION

This application claims priority from and the benefit under 35 U.S.C. §119(a) of Korean Patent Application No. 10-2014-0144129, filed on Oct. 23, 2014, which is hereby incorporated by reference for all purposes as if fully set forth herein.

BACKGROUND

1. Field of Technology

The present disclosure relates to a display device and a method for driving the same.

2. Description of the Prior Art

With the progress of an information-oriented society, demands for display devices for displaying images have increased in various forms. Recently, various display devices, such as a liquid crystal display (LCD) device, a plasma display panel (PDP), an organic light emitting diode display (OLED) device, and the like, have been utilized.

Various types of signal lines are disposed in a display panel of such a display device. Particularly, in order to drive the display panel, common voltage lines, that supply a common voltage which needs to be commonly applied to all sub-pixels, are disposed in the display panel.

The common voltage lines are disposed adjacent to other signal lines, such as data lines and the like. Such physical proximity may cause a coupling phenomenon of a common voltage, which is applied to the display panel through the common voltage lines, when there is a rapid change in a voltage applied through other signal lines, such as data lines and the like, which are adjacent to the common voltage lines.

The coupling phenomenon may cause a charging characteristic of a capacitor within a sub-pixel to be non-uniform, which may result in an image failure phenomenon such as a horizontal crosstalk phenomenon and the like.

SUMMARY

An aspect of the present disclosure is to provide a display device and a method for driving the same, which reduce or prevent a common voltage distortion phenomenon caused by a coupling phenomenon and thereby improve image quality.

Another aspect of the present disclosure is to provide a display device and a method for driving the same, which reduce or prevent a reference voltage distortion phenomenon caused by a coupling phenomenon of a reference voltage (Vref) applied to an organic light emitting display panel and thereby improve image quality.

In accordance with an aspect of the present disclosure, there is provided a display device which includes: a display panel having data lines, gate lines, and common voltage lines disposed therein, and having multiple sub-pixels disposed thereon; a data driver for supplying a data voltage to the data lines; and a common voltage compensator for applying a compensation common voltage obtained by compensating for the common voltage based on a feedback common voltage, which is feedback of a common voltage applied to the display panel through the common voltage lines, and a reference common voltage, to the display panel through the common voltage lines.

In accordance with another aspect of the present disclosure, there is provided a method for driving a display device.

The method includes: applying a common voltage to a display panel through common voltage lines; receiving, as input, a feedback common voltage, which is feedback of the common voltage applied to the display panel, and a reference common voltage; and applying a compensation common voltage, which is obtained by compensating for the common voltage based on the feedback common voltage and the reference common voltage, to the display panel through the common voltage lines.

The above-described embodiments of the present disclosure can provide the display device and the method for driving the same, which reduce or prevent a common voltage distortion phenomenon caused by a coupling phenomenon and thereby improve image quality.

Also, the above-described embodiments of the present disclosure can provide the display device and the method for driving the same, which reduce or prevent a reference voltage distortion phenomenon caused by a coupling phenomenon of a reference voltage (Vref) applied to an organic light emitting display panel and thereby improve image quality.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION

Figure 1:
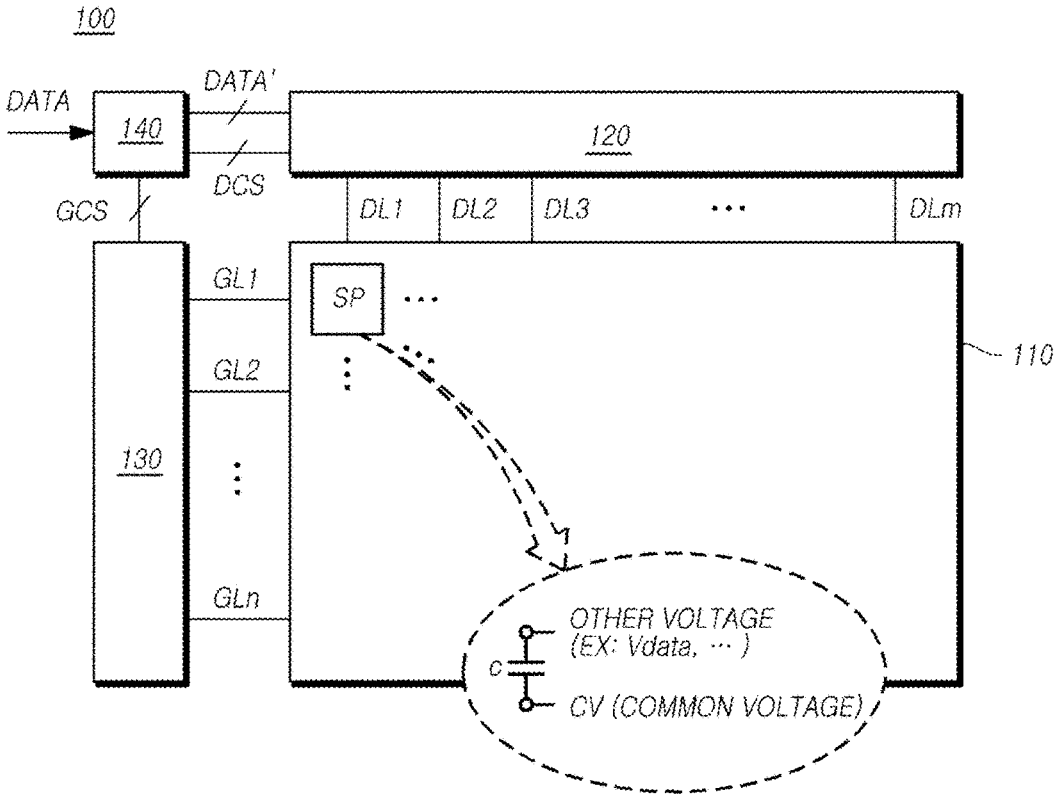
FIG. 1 is a view illustrating a system configuration of a display device according to embodiments of the present disclosure.

Hereinafter, embodiments of the present disclosure will be described in detail with reference to the accompanying drawings. In designating elements of the drawings by reference numerals, the same elements will be designated by the same reference numerals although they are shown in different drawings. Further, in the following description of the present invention, a detailed description of known functions and configurations incorporated herein will be omitted when it may make the subject matter of the present invention rather unclear.

In addition, terms, such as first, second, A, B, (a), (b) or the like may be used herein when describing components of the present disclosure. Each of these terminologies is not used to define an essence, order or sequence of a corresponding component but used merely to distinguish the corresponding component from other component(s). In the case that it is described that a certain structural element "is connected to", "is coupled to", or "is in contact with" another structural element, it should be interpreted that another structural element may "be connected to", "be coupled to", or "be in contact with" the structural elements as well as that the certain structural element is directly connected to or is in direct contact with another structural element.

Figure 2:
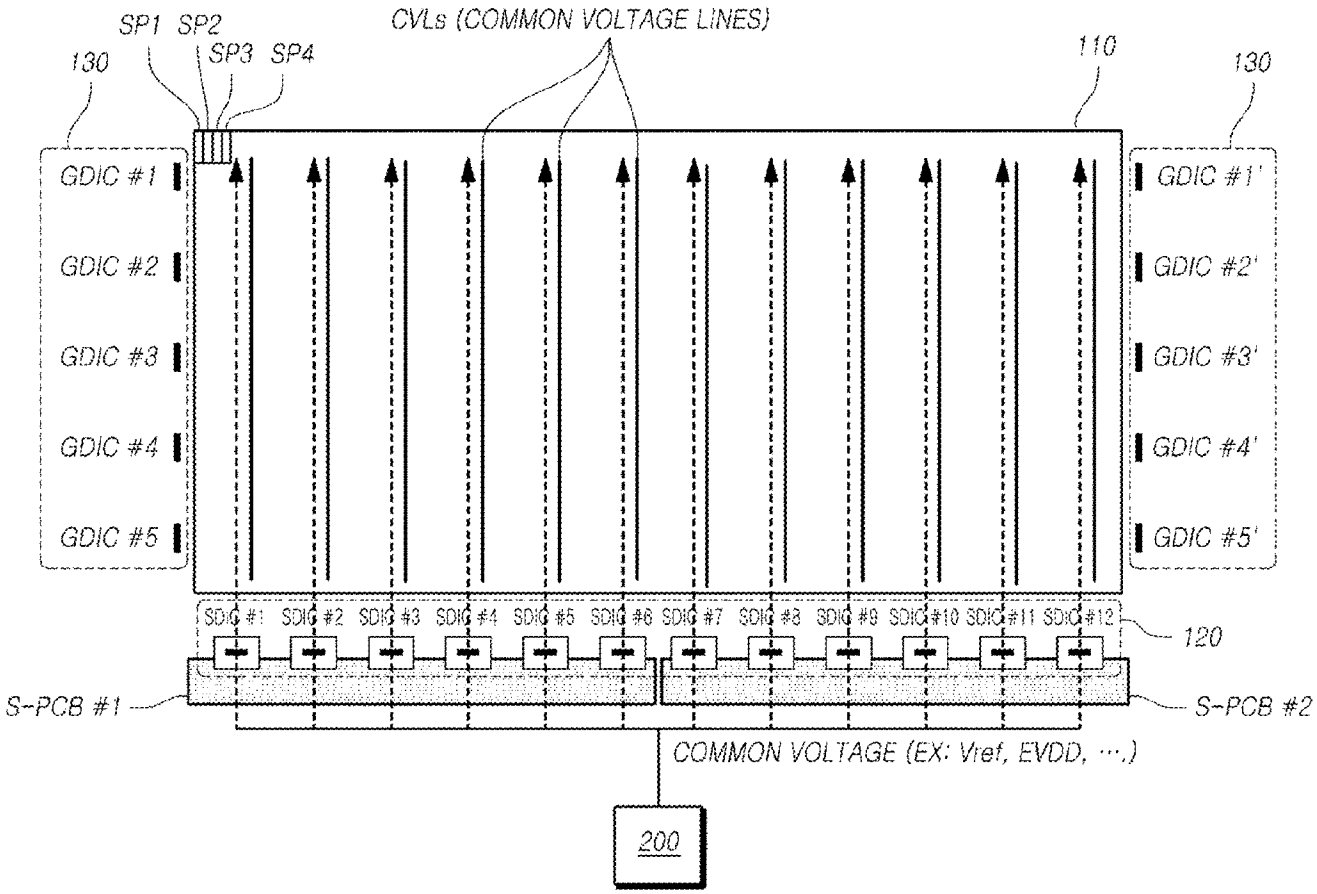
FIG. 2 is a view illustrating the supply of a common voltage in a display device according to embodiments of the present disclosure.

FIG. 1 is a view schematically illustrating a system configuration of a display device 100 according to embodiments of the present disclosure. FIG. 2 is a view illustrating the supply of a common voltage in the display device 100 according to embodiments of the present disclosure.

Referring to FIG. 1, the display device 100 according to embodiments of the present disclosure includes: a display panel 110 in which an m number of data lines DL1, . . . , and DLm (m represents a natural number) and an n number of gate lines GL1, . . . , and GLn (n represents a natural number) are disposed such that them number of data lines DL1, . . . , and DLm intersect with the n number of gate lines GL1, . . . , and GLn, and in which multiple sub-pixels (SPs) are disposed in a matrix form; a data driver 120 that supplies data voltages to the m number of data lines DL1, . . . , and DLm in order to drive the m number of data lines DL1, . . . , and DLm; a gate driver 130 that sequentially supplies scan signals to the n number of gate lines GL1, . . . , and GLn in order to sequentially drive then number of gate lines GL1, . . . , and GLn; a timing controller 140 that controls the data driver 120 and the gate driver 130; and the like.

In the display panel 110, a SP may be disposed at each point where one data line intersects with one or more gate lines.

The timing controller 140 starts a scan according to a timing implemented in each frame, converts image data (as indicated by Data) input from an interface so as to meet a data signal format used by the data driver 120 and outputs the converted image data (as indicated by Data'), and controls data driving at an appropriate time point according to the scan.

The timing controller 140 outputs various control signals in order to control the data driver 120 and the gate driver 130.

According to the control of the timing controller 140, the gate driver 130 sequentially supplies a scan signal having an on voltage or off voltage to then number of gate lines GL1, . . . , and GLn, and sequentially drives then number of gate lines GL1, . . . , and GLn.

According to a driving type, the gate driver 130 may be disposed at only one side of the display panel 110 as illustrated in FIG. 1, or the gate driver 130 may be divided into two parts and the two parts may be disposed at both sides of the display panel 110 as illustrated in FIG. 2.

Also, the gate driver 130 may include multiple gate driver integrated circuits (GDICs) GDIC #1, . . . , and GDIC #5, and GDIC #1', . . . , and GDIC #5' as illustrated in FIG. 2. The multiple GDICs GDIC #1, . . . , and GDIC #5, and GDIC #1', . . . , and GDIC #5' may be connected to a bonding pad of the display panel 110 according to a tape automated bonding (TAB) scheme or a chip-on-glass (COG) scheme, or may be implemented in a gate-in-panel (GIP) type and may be directly disposed in the display panel 110. According to circumstances, the multiple GDICs GDIC #1, . . . , and GDIC #5, and GDIC #1', . . . , and GDIC #5' may be integrated into the display panel 110 and may be disposed in the display panel 110.

Each of the multiple GDICs GDIC #1, . . . , and GDIC #5, and GDIC #1', . . . , and GDIC #5' may include a shift register, a level shifter, and the like.

According to the control of the timing controller 140, the data driver 120 stores image data (indicated by Data), which has been input from a host system (not illustrated), in a memory (not illustrated). When a particular gate line is opened, according to the control of the timing controller 140, the data driver 120 converts the relevant image data (indicated by Data') into a data voltage Vdata having an analog form, supplies the data voltage Vdata to them number of data lines DL1, . . . , and DLm, and thereby drives them number of data lines DL1, . . . , and DLm.

The data driver 120 may include multiple source driver ICs (SDICs) (or referred to as "Data Driver ICs") SDIC #1, . . . , and SDIC #12 as illustrated in FIG. 2. The multiple SDICs SDIC #1, . . . , and SDIC #12 may be connected to a bonding pad of the display panel 110 according to the TAB scheme or the COG scheme, or may be directly disposed in the display panel 110. According to circumstances, the multiple SDICs SDIC #1, . . . , and SDIC #12 may be integrated into the display panel 110 and may be disposed in the display panel 110.

Each of the multiple SDICs SDIC #1, . . . , and SDIC #12 may include a shift register, a latch, a digital-to-analog converter (DAC), an output buffer, and the like. According to circumstances, each of the multiple SDICs SDIC #1, . . . , and SDIC #12 may further include an analog-to-digital converter (ADC) that, in order to compensate for a SP, senses an analog voltage value and converts the sensed analog voltage value into a digital value, and generates and outputs sensing data.

Referring to FIG. 2, the multiple SDICs SDIC #1, . . . , and SDIC #12 may be implemented in a chip on film (COF) scheme. In each of the multiple SDICs SDIC #1, . . . , and SDIC #12, one end is bonded to at least one source printed circuit board (S-PCB) S-PCB #1 and S-PCB #2, and the other end is bonded to the display panel 110.

Meanwhile, the above-described host system (not illustrated) transmits, together, digital video data (indicated by Data) of an input image, and various timing signals, which include a vertical synchronization signal Vsync, a horizontal synchronization signal Hsync, an input Data Enable (DE) signal, a clock signal CLK, and the like, to the timing controller 140.

The timing controller 140 converts image data (as indicated by Data) input from the host system (not illustrated) so as to meet a data signal format used by the data driver 120, and outputs the converted image data (as indicated by Data'). In addition, in order to control the data driver 120 and the gate driver 130, the timing controller 140 receives, as input, timing signals (e.g., a vertical synchronization signal Vsync, a horizontal synchronization signal Hsync, an input DE signal, a clock signal, etc.), generates various control signals, and outputs the generated control signals to the data driver 120 and the gate driver 130.

For example, in order to control the gate driver 130, the timing controller 140 outputs gate control signals (GCSs) including a gate start pulse (GSP), a gate shift clock (GSC), a gate output enable signal (GOE), and the like. A GSP controls an operation start timing of the GDICs GDIC #1, . . . , and GDIC #5, and GDIC #1', . . . , and GDIC #5' of the gate driver 130. A GSC is a clock signal which is commonly input to the GDICs GDIC #1, . . . , and GDIC #5, and GDIC #1', . . . , and GDIC #5', and controls a shift timing of a scan signal (i.e., a gate pulse). A GOE designates timing information of the GDICs GDIC #1, . . . , and GDIC #5, and GDIC #1', . . . , and GDIC #5'.

In order to control the data driver 120, the timing controller 140 outputs Data Control Signals (DCSs) including a source start pulse (SSP), a source sampling clock (SSC), a source output enable signal (SOE), and the like. A SSP controls a data sampling start timing of the SDICs SDIC #1, . . . , and SDIC #12 of the data driver 120. An SSC is a clock signal which controls a sampling timing of data in each of the SDICs SDIC #1, . . . , and SDIC #12. A SOE controls an output timing of the data driver 120. According to circumstances, the DCSs may further include a polarity control signal (POL) in order to control the polarity of a data voltage of the data driver 120. A SSP and a SSC may be omitted when data (indicated by Data') input to the data driver 120 is transmitted according to a mini Low Voltage Differential Signaling (LVDS) interface standards.

The display device 100, which is schematically illustrated in FIG. 1, may be one of, for example, a liquid crystal display (LCD) device, a plasma display panel (PDP) device, an organic light emitting diode (OLED) display device, and the like.

Each SP disposed on the display panel 110 includes circuit elements, such as a transistor, a capacitor, and the like. For example, when the display panel 110 is an organic light emitting display panel, each SP has circuit elements, such as an OLED, two or more transistors, one or more capacitors, and the like, formed therein.

Meanwhile, referring to FIGS. 1 and 2, in order to drive each SP, various common voltages (CVs) need to be applied to the display panel 110. Accordingly, the display panel 110 has common voltage lines (CVLs) formed therein.

Referring to FIG. 1, a CV may be applied to one end of a capacitor C within each SP through CVLs. At this time, a unique pixel voltage of the relevant SP, such as a data voltage Vdata, may be applied to the other end of the capacitor C within each SP.

Referring to FIG. 2, a CV is applied to the display panel 110. Specifically, the CV is supplied to each SP through the CVLs disposed in the display panel 110.

Referring to FIG. 2, the display device 100 may further include a power controller 200 that supplies a CV.

Here, the power controller 200 may be referred to as a "power management IC (PMIC)" and may be disposed on a control printed circuit board (C-PCB) which is connected through the S-PCBs S-PCB #1 and S-PCB #2 and a flexible flat cable (FFC) or a flexible printed circuit (FPC), and/or the like. The C-PCB may have the timing controller 140 disposed thereon.

The power controller 200 may supply a CV to the display panel 110 through the SDICs SDIC #1, . . . , and SDIC #12 disposed on the S-PCBs S-PCB #1 and S-PCB #2.

The type of the CV applied to the display panel 110 may be changed according to the type (e.g., an OLED display device, an LCD device, etc.) of the display device 100, an SP structure thereof, and the like.

For example, when the display device 100 is an OLED display device, examples of the CV applied to the display panel 110 may include a reference voltage Vref, a driving voltage EVDD, a base voltage EVSS, and the like. When the display device 100 is a LCD device, examples of the CV applied to the display panel 110 may include a common voltage Vcom applied to a common electrode that faces a pixel electrode, and the like.

Meanwhile, the display panel 110 has not only the CVLs but also other voltage lines, such as data lines and the like, formed therein.

Accordingly, a coupling phenomenon may occur to a CV applied to the CVLs by other voltage lines adjacent to the CVLs.

The coupling phenomenon of the CV will be described below with reference to FIG. 3.

Figure 3:
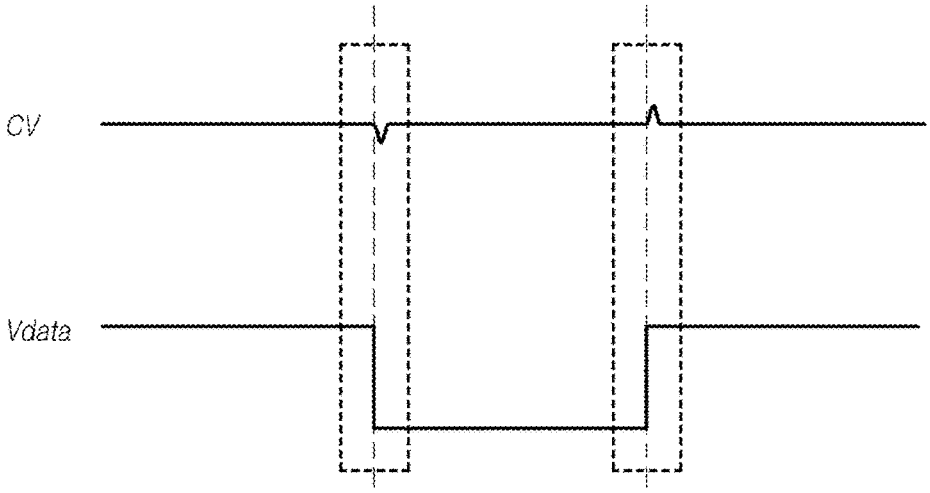
FIG. 3 is a view illustrating a common voltage coupling phenomenon in a display device according to embodiments of the present disclosure.

FIG. 3 is a view illustrating a common voltage coupling phenomenon in the display device 100 according to embodiments of the present disclosure.

FIG. 3 is a view illustrating a coupling phenomenon of a reference voltage Vref which is one type of a CV.

Referring to FIG. 3, when a data voltage Vdata supplied through data lines rapidly changes, namely, when the data voltage Vdata changes from a high level to a low level or when the data voltage Vdata changes from the low level to the high level, a phenomenon may occur in which a reference voltage Vref, which is a CV applied through Reference Voltage Lines (RVLs) corresponding to CVLs adjacent to the data lines at a point where the data voltage Vdata rapidly changes, becomes smaller or larger than a desired voltage value.

Specifically, referring to FIG. 3, when the data voltage Vdata supplied through the data lines swings, a kickback phenomenon in the display panel 110 may cause a coupling phenomenon to occur to the reference voltage Vref which is the CV applied to the RVLs corresponding to the CVLs adjacent to the data lines.

The coupling phenomenon of the CV causes a charging characteristic of a capacitor C, to which the CV is applied, to be non-uniform. The non-uniform charging characteristic may cause an image failure phenomenon, such as horizontal crosstalk and the like.

Accordingly, embodiments of the present disclosure provide a common voltage compensation function of reducing a common voltage distortion caused by a common voltage coupling phenomenon, and a configuration and a method for the same.

Hereinafter, common voltage compensation according to embodiments of the present disclosure will be described with reference to FIGS. 4 to 15.

Figure 4:
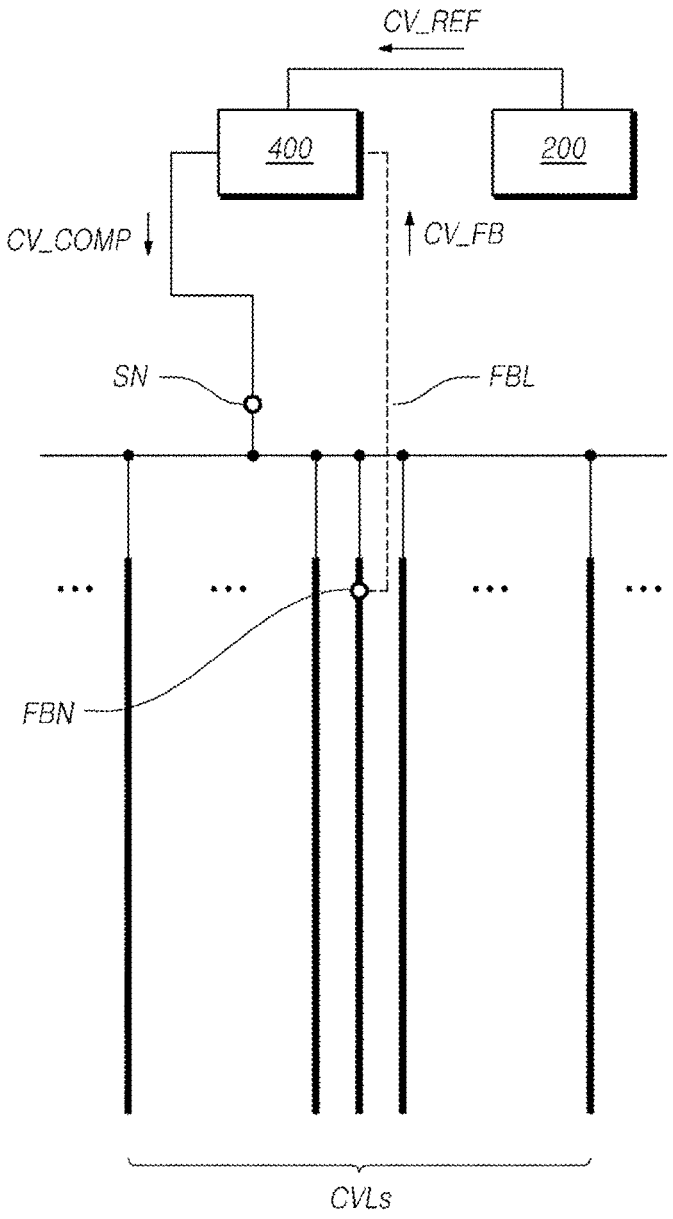
FIG. 4 is a view illustrating a common voltage compensation configuration for reducing a common voltage distortion phenomenon caused by a common voltage coupling phenomenon in a display device according to embodiments of the present disclosure.

FIG. 4 is a view illustrating a common voltage compensation configuration for reducing a common voltage distortion phenomenon caused by a common voltage coupling phenomenon in the display device 100 according to embodiments of the present disclosure.

Referring to FIG. 4, the display device 100 according to embodiments of the present disclosure includes a common voltage compensator 400 that receives feedback of a CV applied to the display panel 110 through CVLs, compensates for a CV on the basis of the fed-back CV CV_FB (hereinafter referred to as a "feedback CV") and a reference CV CV_REF, and applies the compensated CV CV_COMP (hereinafter referred to as a "compensation CV") to the display panel 110 through the CVLs.

The compensation CV CV_COMP is a voltage which causes a reference CV CV_REF, which is desired to be applied to the display panel 110, to be actually applied to the display panel 110. When a coupling phenomenon does not occur, the compensation CV CV_COMP is identical or similar to the reference CV CV_REF. In contrast, when the coupling phenomenon occurs, the compensation CV CV_COMP is different from the reference CV CV_REF. The difference is removed by the coupling phenomenon, and a voltage identical to the reference CV CV_REF is actually applied to the display panel 110.

When the common voltage compensator 400 is used, if a CV having a different voltage value from a desired voltage value due to the common voltage coupling phenomenon is applied to the display panel 110, the common voltage compensator 400 applies the CV having the desired voltage value to the display panel 110 through the compensation, and thereby the common voltage distortion phenomenon caused by the common voltage coupling phenomenon can be reduced, so that image quality can be also improved.

Referring to FIG. 4, the common voltage compensator 400 receives a reference CV CV_REF as input from the power controller 200, and receives a feedback CV CV_FB as input through a Feed Back Line (FBL) connected to a feed back node (FBN) existing on at least one CVL from among CVLs. Here, the FBN is a particular or optional node existing on particular or optional one or more CVLs or two or more CVLs from among the CVLs, and is a node on the display panel 110.

Referring to FIG. 4, the common voltage compensator 400 applies the compensation CV CV_COMP to the CVLs through a supply node (SN) on the basis of the input reference CV CV_REF and the feedback CV CV_FB. Here, the SN is one node to which the CVLs, to which the compensation CV CV_COMP needs to be applied, are commonly connected. The SN may be one point inside each of multiple SDICs, or may be one point outside each thereof.

The above-described common voltage feedback structure and compensation common voltage supply structure allows common voltage compensation to be efficiently performed.

A compensation CV CV_COMP, which is again applied to the display panel 110 through compensation for the CV applied to the display panel 110 by the common voltage compensator 400, is a voltage commonly applied to multiple SPs, and may be a voltage applied to one end of a capacitor C within each SP.

The compensation CV CV_COMP is applied to one end of the capacitor C within each SP as described above, and thereby it is possible to prevent a charging characteristic of the capacitor C from becoming non-uniform, so that image quality can be improved.

Figure 5:
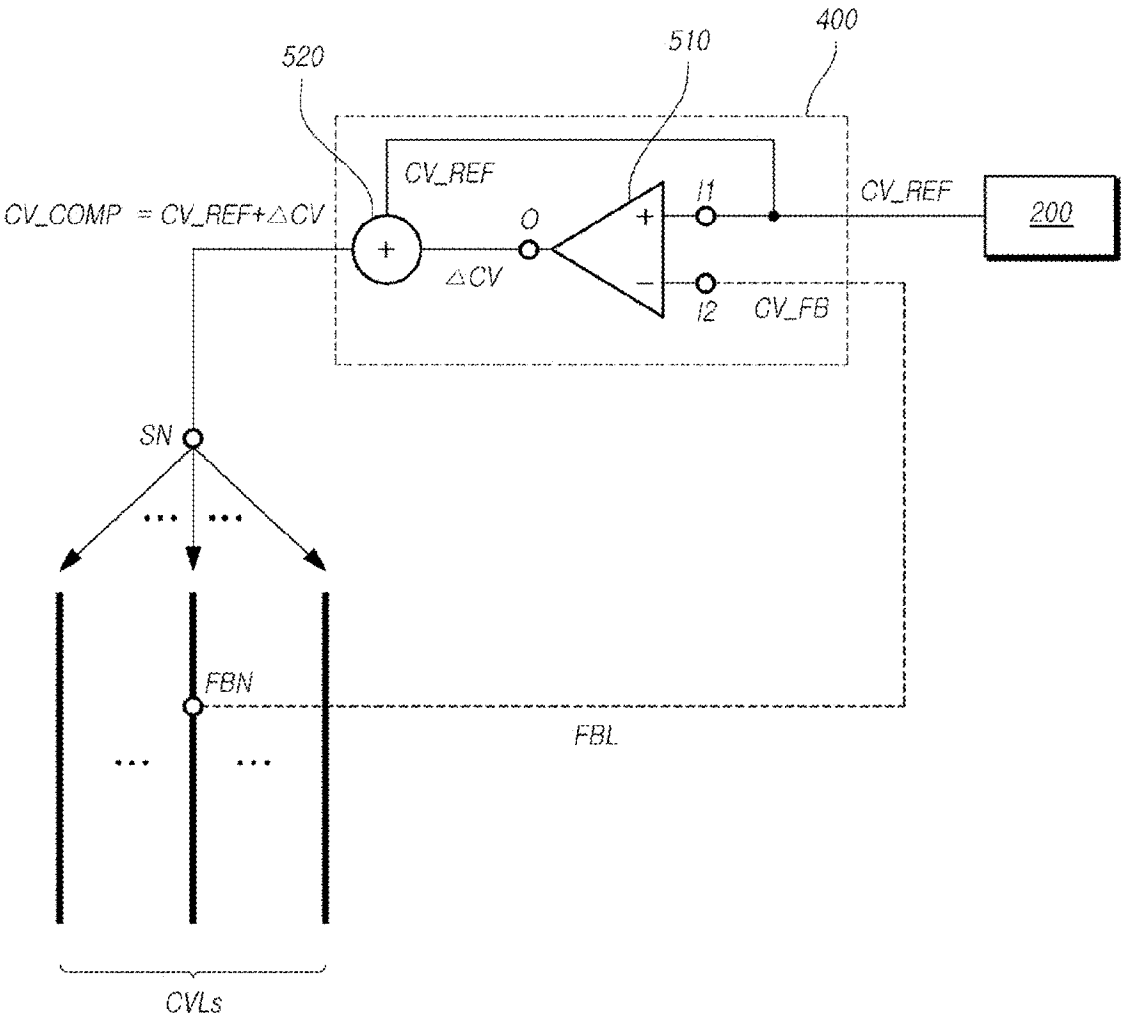
FIG. 5 is a view illustrating an example of a common voltage compensator of a display device according to embodiments of the present disclosure.

FIG. 5 is a view illustrating an example of the common voltage compensator 400 of the display device 100 according to embodiments of the present disclosure.

Referring to FIG. 5, the common voltage compensator 400 of the display device 100, according to embodiments of the present disclosure, may include a difference voltage output unit 510, a compensation common voltage output unit 520, and the like.

Referring to FIG. 5, the difference voltage output unit 510 has a first input terminal I1 that receives a reference CV CV_REF as input from the power controller 200, a second input terminal I2 that receives a feedback CV CV_FB as input from a FBL, and an output terminal O that outputs a difference voltage ΔCV (i.e., ΔCV=CV_REF-CV_FB) between the reference CV CV_REF and the feedback CV CV_FB.

The difference voltage output unit 510 may be implemented by, for example, a kind of comparator, a kind of amplifier (e.g., operational amplifier (op-amp)), and/or the like.

Referring to FIG. 5, the compensation common voltage output unit 520 outputs a compensation CV CV_COMP on the basis of the reference CV CV_REF and the difference voltage ΔCV, and applies the compensation CV CV_COMP to CVLs through an SN.

As an example, the compensation common voltage output unit 520 may be implemented by a kind of adder, and a compensation CV CV_COMP may be obtained by adding up the reference CV CV_REF and the difference voltage ΔCV.

For example, when a reference CV CV_REF is equal to 5 V, if a feedback CV CV_FB is equal to 4.7 V lower than a desired voltage value of 5 V, a difference voltage ΔCV is equal to +0.3 V, and a compensation CV CV_COMP is obtained by 5 V+(+0.3 V)=5.3 [V]. The compensation common voltage output unit 520 outputs the compensation CV CV_COMP of 5.3 V, and thus the desired voltage value of 5 V may be applied to the CVLs in the display panel 110 even when the difference voltage ΔCV of 0.3 V is generated.

As described above, the common voltage compensator 400 may be implemented with a simple circuit configuration. Accordingly, when a CV actually applied to the display panel 110 is different from a desired voltage value, namely, when there occurs a common voltage distortion phenomenon caused by a coupling phenomenon, the common voltage compensator 400 applies the compensation CV CV_COMP to the CVLs through the common voltage compensation even without using a complex circuit or an expensive element. Therefore, the occurrence of the common voltage distortion phenomenon caused by the coupling phenomenon can be efficiently reduced or prevented.

Figure 6:
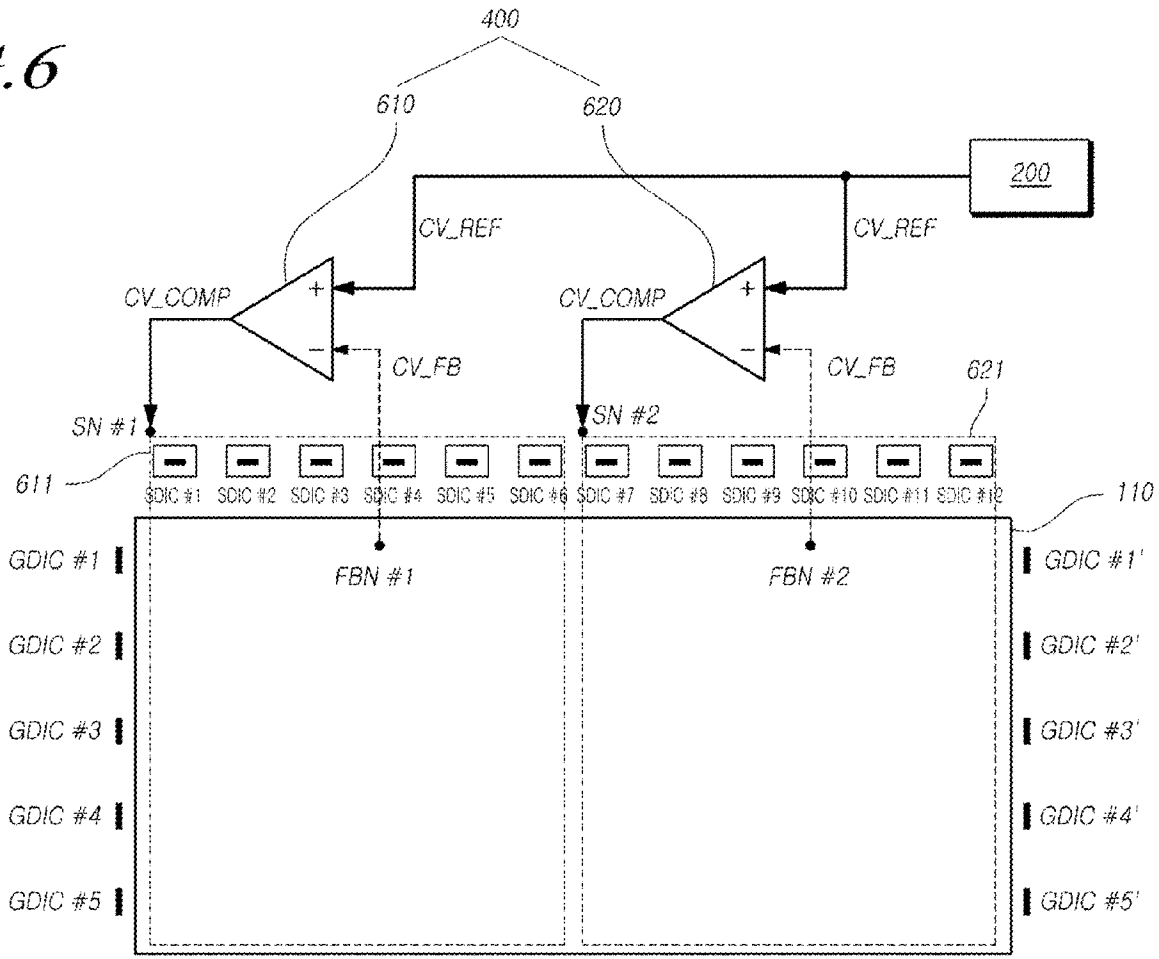
FIG. 6 is a view illustrating another example of a common voltage compensator of a display device according to embodiments of the present disclosure.

FIG. 6 is a view illustrating another example of the common voltage compensator 400 of the display device 100 according to embodiments of the present disclosure.

Referring to FIG. 6, the common voltage compensator 400 may include op-amp circuits 610 and 620.

FIG. 6 is a view illustrating an example of implementing the common voltage compensator 400 using op-amp circuits 610 and 620 under the system configuration of the display device 100 illustrated as an example in FIG. 2.

Referring to FIG. 6, the two op-amp circuits 610 and 620 correspond to the two S-PCBs S-PCB #1 and S-PCB #2, respectively.

Referring to FIG. 6, the left op-amp circuit 610 from among the two op-amp circuits 610 and 620 applies a compensation CV CV_COMP to CVLs, which are disposed in a left area 611 of the display panel 110, through the six SDICs SDIC #1, . . . , and SDIC #6 which are connected to the left S-PCB S-PCB #1 from among the two S-PCBs S-PCB #1 and S-PCB #2.

In order to apply the compensation CV CV_COMP to the CVLs disposed in the left area 611 of the display panel 110, the left op-amp circuit 610 receives, as a feedback CV CV_FB, feedback of a CV actually applied to an FBN FBN #1 on at least one CVL from among the CVLs disposed in the left area 611 of the display panel 110, and receives a reference CV CV_REF as input from the power controller 200.

The left op-amp circuit 610 receives, as input, the reference CV CV_REF and the feedback CV CV_FB, obtains the compensation CV CV_COMP and outputs the compensation CV CV_COMP to a relevant SN SN #1 in the scheme described above with reference to FIG. 5, and thereby applies the compensation CV CV_COMP to the CVLs which are disposed in the left area 611 of the display panel 110 and are electrically connected to the relevant SN SN #1.

Similarly, referring to FIG. 6, the right op-amp circuit 620 from among the two op-amp circuits 610 and 620 applies a compensation CV CV_COMP to CVLs, which are disposed in a right area 621 of the display panel 110, through the six SDICs SDIC #7, . . . , and SDIC #12 which are connected to the right S-PCB S-PCB #2 from among the two S-PCBs S-PCB #1 and S-PCB #2.

In order to apply the compensation CV CV_COMP to the CVLs disposed in the right area 621 of the display panel 110, the right op-amp circuit 620 receives, as a feedback CV CV_FB, feedback of a CV actually applied to an FBN FBN #2 on at least one CVL from among the CVLs disposed in the right area 621 of the display panel 110, and receives a reference CV CV_REF as input from the power controller 200.

The right op-amp circuit 620 receives, as input, the reference CV CV_REF and the feedback CV CV_FB, obtains the compensation CV CV_COMP and outputs the compensation CV CV_COMP to a relevant SN SN #2 in the scheme described above with reference to FIG. 5, and thereby applies the compensation CV CV_COMP to the CVLs which are disposed in the right area 621 of the display panel 110 and are electrically connected to the relevant SN SN #2.

As described above, the common voltage compensator 400 may be implemented by configuring the simple op-amp circuits 610 and 620. Accordingly, the common voltage compensator 400 applies the compensation CV CV_COMP to the CVLs through the common voltage compensation even without using a complex circuit or an expensive element. Therefore, the occurrence of the common voltage distortion phenomenon caused by the coupling phenomenon can be efficiently reduced or prevented.

Figure 7:
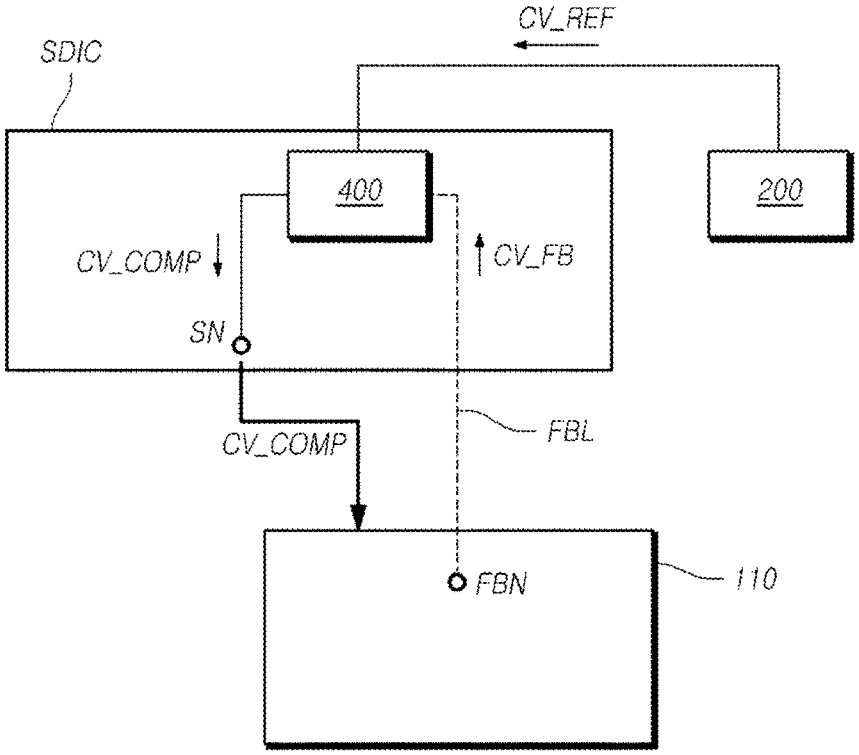
FIG. 7 is a view illustrating a common voltage compensator implemented as an internal element of a source driver integrated circuit of a display device according to embodiments of the present disclosure.

FIG. 7 is a view illustrating the common voltage compensator 400 implemented as an internal element of the source driver integrated circuit (SDIC) of the display device 100 according to embodiments of the present disclosure.

Referring to FIG. 7, the common voltage compensator 400 may be included in each of SDICs of the data driver 120.

In this case, one common voltage compensator 400 may be included in each of all of the SDICs SDIC #1, . . . , and SDIC #12.

Alternatively, one common voltage compensator 400 may be included in only at least one SDIC from among all of the SDICs SDIC #1, . . . , and SDIC #12. In this case, after a compensation CV CV_COMP is output from a particular SDIC including the common voltage compensator 400, the compensation CV CV_COMP may be supplied to CVLs through a compensation common voltage line (not illustrated).

As described above, the common voltage compensator 400 may be included in the SDIC. Accordingly, a separate space, in which the common voltage compensator 400 is to be disposed, is not required, so that it can be easy to design a PCB and the like.

Figure 8:
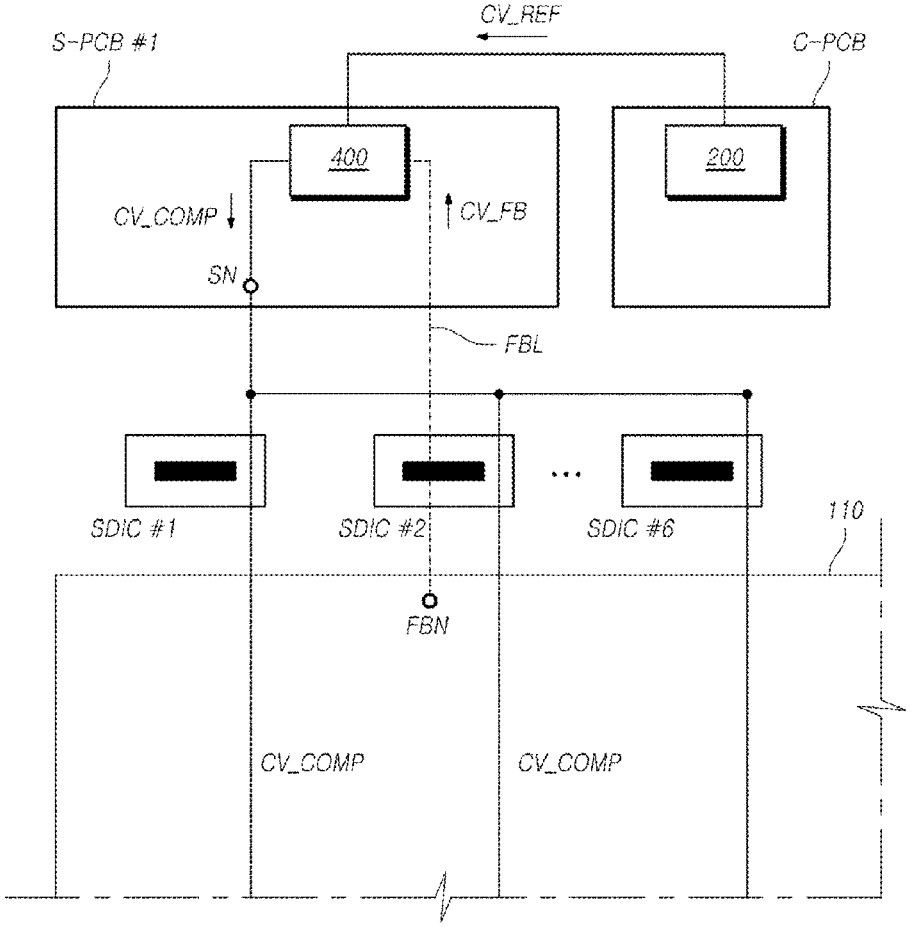
FIG. 8 is a view illustrating a common voltage compensator implemented as a circuit on a source printed circuit board of a display device according to embodiments of the present disclosure.

FIG. 8 is a view illustrating the common voltage compensator 400 implemented as a circuit on the source printed circuit board (S-PCB) S-PCB #1 of the display device 100 according to embodiments of the present disclosure.

Referring to FIG. 8, the common voltage compensator 400 may be as a circuit implemented on the S-PCB S-PCB #1. At this time, the common voltage compensator 400 may be designed as the circuit illustrated in FIG. 5 or FIG. 6.

Referring to FIG. 8, the common voltage compensator 400 implemented as a circuit on the S-PCB S-PCB #1 receives a reference CV CV_REF as input from the power controller 200 disposed on a C-PCB, and receives a CV as input, which is actually applied to the display panel 110, as a feedback CV CV_FB through a common voltage line FBL.

Referring to FIG. 8, the common voltage compensator 400 outputs a compensation CV CV_COMP to a SN in the scheme described above with reference to FIG. 5 on the basis of the input reference CV CV_REF and the feedback CV CV_FB.

The output compensation CV CV_COMP is supplied to the relevant CVLs through the relevant SDICs SDIC #1, SDIC #2, . . . , and SDIC #6.

As described above, the common voltage compensator 400 may be implemented on the S-PCB S-PCB #1, and thus it is advantageous in that an expensive SDIC may not be changed. Particularly, when the common voltage compensator 400 is configured as a simple circuit illustrated in FIG. 5 or FIG. 6, the common voltage compensator 400 can be easily implemented on the S-PCB S-PCB #1 at low cost.

Hereinabove, the description has been made of the common voltage compensation for reducing or preventing the common voltage distortion phenomenon caused by the common voltage coupling phenomenon according to embodiments of the present disclosure. Hereinafter, when the display device 100 according to embodiments of the present disclosure is an OLED display device, common voltage distortion will be briefly described.

Figure 9:
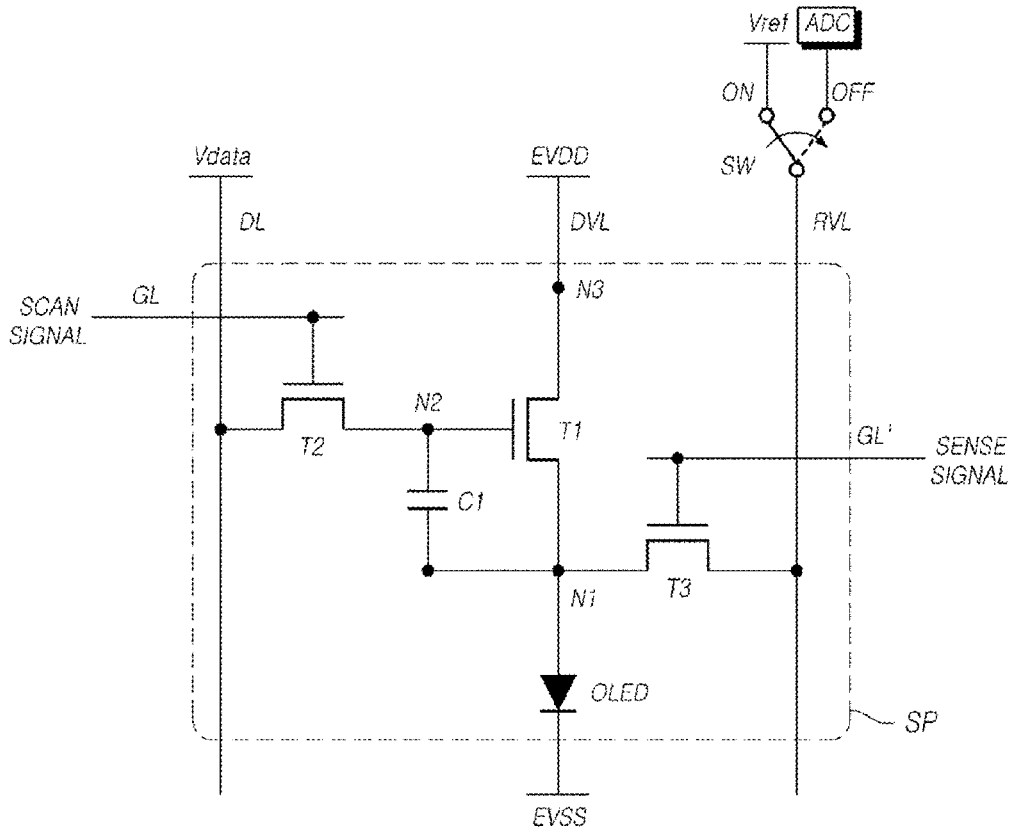
FIG. 9 is a view illustrating an example of a sub-pixel structure of a display device according to embodiments of the present disclosure.
Figure 10:
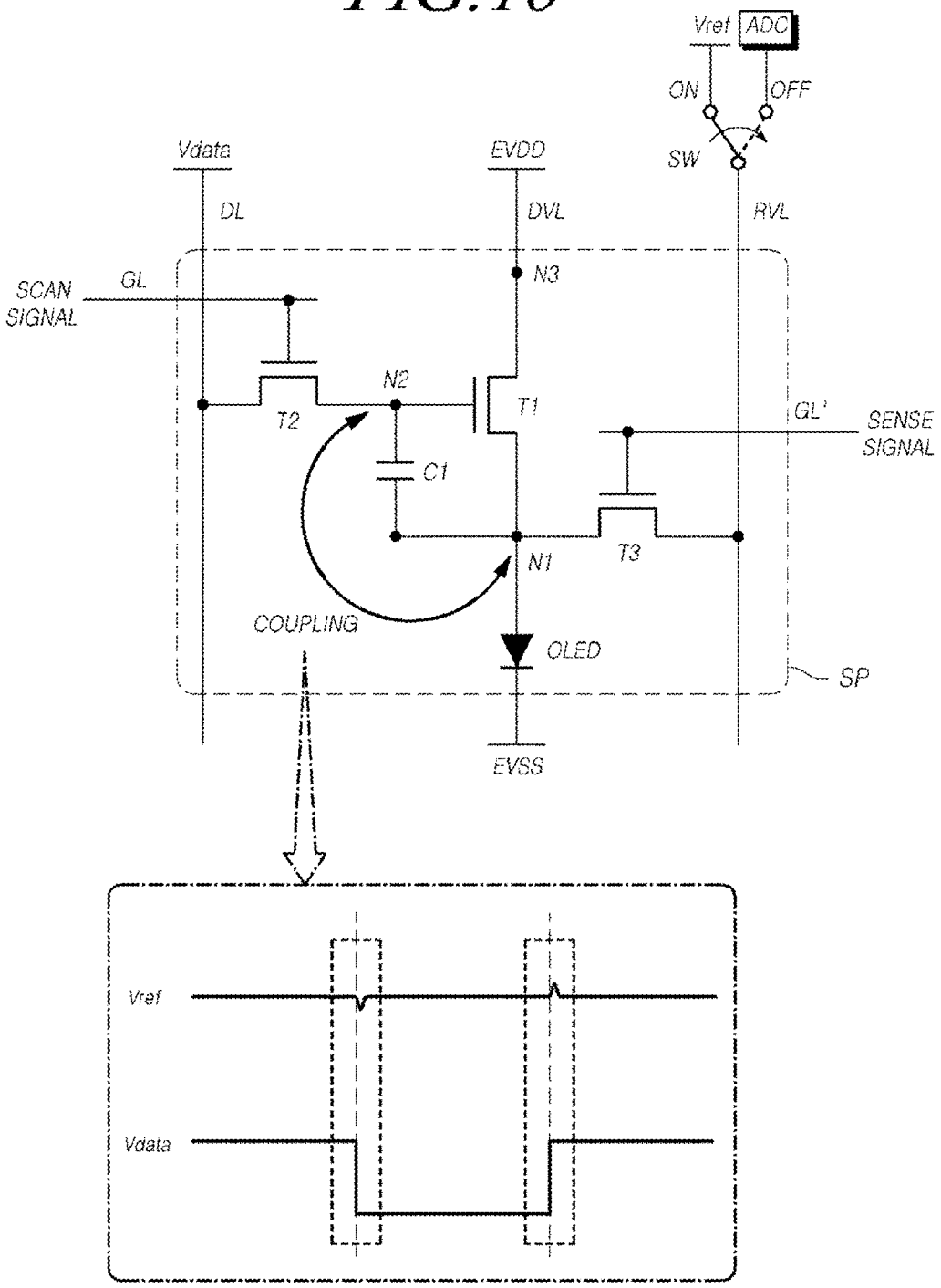
FIG. 10 is a view illustrating a reference voltage (Vref) coupling phenomenon in the sub-pixel structure illustrated in FIG. 9.

FIG. 9 is a view illustrating an example of a sub-pixel structure of the display device 100 according to embodiments of the present disclosure. FIG. 10 is a view illustrating a reference voltage (Vref) coupling phenomenon in the sub-pixel structure illustrated in FIG. 9.

When the display device 100 according to embodiments of the present disclosure is an OLED display device, each SP may be configured as a circuit including an OLED, and two or more transistors and one or more capacitors for driving the OLED.

FIG. 9 is a circuit diagram illustrating an example of an equivalent circuit of a SP including three transistors T1, T2 and T3, and one capacitor C1.

Referring to FIG. 9, each SP includes an OLED, a first transistor T1, a second transistor T2, a third transistor T3, and a first capacitor C1.

The first transistor T1 is a driving transistor that drives the OLED, and is connected between the OLED and a driving voltage line (DVL) or a pattern connected to the DVL.

In the first transistor T1, a second node N2 is a gate node, a first node N1 is a source node or a drain node, and a third node N3 is a drain node or a source node.

The second transistor T2 is a switching transistor that controls the turn on and turn off of the first transistor T1, and is connected between the second node (gate node) N2 of the first transistor T1 and a data line (DL).

The third transistor T3 is connected between the first node N1 (the source node or drain node) of the first transistor T1 and a reference voltage line (RVL) or a pattern connected to the RVL.

The first capacitor C1 is connected between the first node N1 of the first transistor T1 and the second node N2 thereof, and serves as a storage capacitor that maintains a predetermined voltage during one frame.

Referring to FIG. 9, the turn on and turn off of the second transistor T2 is controlled by a scan signal supplied from a first gate line (GL). When the second transistor T2 is turned on, the second transistor T2 applies a data voltage Vdata, which is supplied from a data line (DL), to the second node N2 of the first transistor T1.

Referring to FIG. 9, a switch SW is connected to the end of the RVL.

When the switch SW is turned on, the switch SW supplies a reference voltage Vref to the RVL. In contrast when the switch SW is turned off, the switch SW connects the RVL to an analog-to-digital converter (ADC).

Referring to FIG. 9, the turn on and turn off of the third transistor T3 is controlled by a sense signal which is a kind of gate signal supplied through a second gate line GL'. When the switch SW is turned on and the third transistor T3 is turned on, the reference voltage Vref is applied to the first node N1 of the first transistor T1.

Referring to FIG. 9, when the switch SW is turned off and the third transistor T3 is turned on, a voltage of the first node N1 of the first transistor T1 is sensed by the ADC.

The ADC generates sensing data by converting the sensed voltage into a digital value, and provides the generated sensing data to the timing controller 140.

Here, the sensing voltage of the first node N1 of the first transistor T1 is a voltage which reflects a unique characteristic value (e.g., a threshold voltage, etc.) of the first transistor T1. Accordingly, the timing controller 140 may perform a compensation process which compensates for a difference between unique characteristic values of the first transistor T1 within each SP on the basis of the received sensing data. In this regard, the third transistor T3 is also referred to as a "sense transistor."

Referring to FIG. 9, the data voltage Vdata and the reference voltage Vref may be applied to both ends of the first capacitor C1.

Referring to FIG. 9, the reference voltage Vref applied to one end of the first capacitor C1 is a kind of common voltage supplied to all of the SPs. Accordingly, the RVL corresponds to a CVL.

The CVL is adjacent to the DL.

Accordingly, when the data voltage Vdata supplied through the data lines rapidly changes, namely, when the data voltage Vdata changes from a high level to a low level or when the data voltage Vdata changes from the low level to the high level, a phenomenon may occur in which the reference voltage Vref, which is applied through the RVLs adjacent to the data lines at a point where the data voltage Vdata rapidly changes, becomes smaller or larger than a desired voltage value.

Specifically, referring to FIG. 10, when the data voltage Vdata supplied through the data lines swings, a kickback phenomenon in the display panel 110 may cause a coupling phenomenon to occur to the reference voltage Vref applied to the RVLs adjacent to the data lines.

The coupling phenomenon causes a charging characteristic of a capacitor C, to which the reference voltage Vref is applied, to be non-uniform. The non-uniform charging characteristic may cause an image failure phenomenon, such as horizontal crosstalk and the like.

Figure 11:
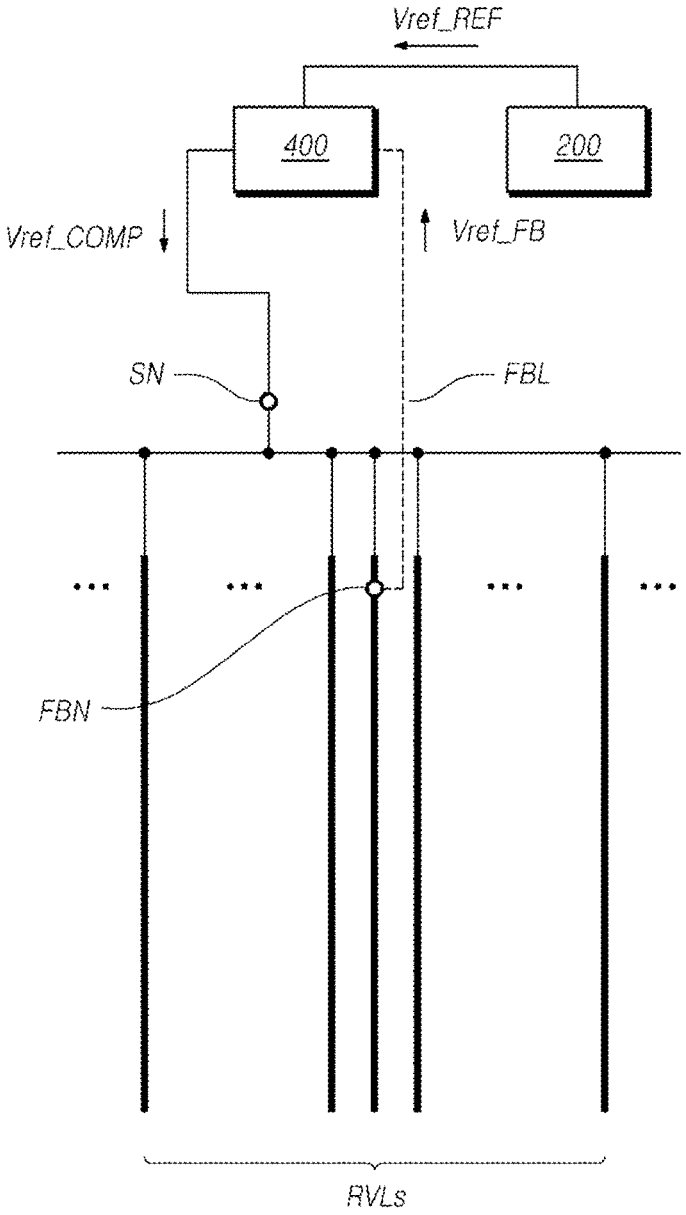
FIG. 11 is a view illustrating a common voltage compensation configuration for reducing a reference voltage distortion phenomenon caused by a reference voltage coupling phenomenon in a display device according to embodiments of the present disclosure.

FIG. 11 is a view illustrating a common voltage compensation configuration for reducing a reference voltage distortion phenomenon caused by a reference voltage coupling phenomenon in the display device 100 according to embodiments of the present disclosure.

Referring to FIG. 11, the common voltage compensator 400 receives feedback of a reference voltage, which is actually applied to the display panel 110 (i.e., actually applied to RVLs), as a feedback reference voltage Vref_FB through an FBL connected to a FBN on at least one RVL from among the RVLs.

Referring to FIG. 11, the common voltage compensator 400 outputs a compensation reference voltage Vref_COMP to a SN on the basis of a reference reference voltage Vref_REF which is input from RVLs and the power controller 200.

Accordingly, the compensation reference voltage Vref_COMP is applied to all of the RVLs electrically connected to the SN.

Therefore, a voltage, which is identical to the reference reference voltage Vref_REF desired to be applied to the display panel 110, is actually applied to the display panel 110.

The RVL is a CVL which supplies the compensation reference voltage Vref_COMP corresponding to a compensation CV CV_COMP. The third transistor T3 is turned on and applies the compensation reference voltage Vref_COMP, which is supplied through the RVL, to the first node N1 of the first transistor T1 and one end of the capacitor C1.

As described above, when a reference voltage Vref having a different voltage value from a desired voltage value is applied to the organic light emitting display panel due to the coupling phenomenon of the reference voltage Vref in the organic light emitting display panel, the compensation for the reference voltage Vref causes the reference voltage Vref having the desired voltage value to be applied to the organic light emitting display panel, and thereby the reference voltage distortion phenomenon caused by the reference voltage coupling phenomenon can be reduced, so that image quality can also be improved.

As described above, the compensation CV CV_COMP supplied to the organic light emitting display panel may be a compensation reference voltage Vref_COMP obtained by compensating for a reference voltage Vref applied to a source node or a drain node of a driving transistor within each SP, may be a compensation driving voltage EVDD_COMP obtained by compensating for a driving voltage EVDD supplied to a driving transistor within each SP according to a SP structure and the like, or may be a compensation base voltage EVSS_COMP obtained by compensating for a base voltage EVSS supplied to a cathode electrode or an anode electrode of an OLED within each SP.

Figure 12:
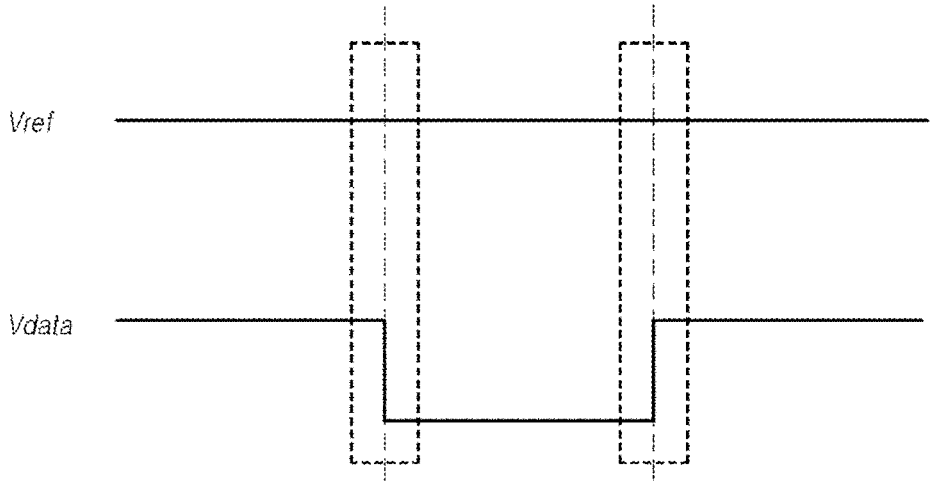
FIG. 12 is a view illustrating a reduction in a reference voltage (Vref) coupling phenomenon and a reference voltage distortion phenomenon caused by the reference voltage coupling phenomenon, through compensation for a reference voltage in a display device according to embodiments of the present disclosure.

FIG. 12 is a view illustrating a reduction in a reference voltage (Vref) coupling phenomenon and a reference voltage distortion phenomenon caused by the reference voltage coupling phenomenon, through compensation for a reference voltage in the display device 100 according to embodiments of the present disclosure.

Referring to FIG. 12, when the above-described reference voltage compensation is applied, differently from FIG. 10, it can be noted that a phenomenon, in which a reference voltage Vref is distorted, does not appear even at a point where a data voltage Vdata rapidly changes.

As described above, when a coupling phenomenon of a driving voltage EVDD or a base voltage EVSS as well as a reference voltage Vref in the organic light emitting display panel causes the driving voltage EVDD or the base voltage EVSS having a different voltage value from a desired voltage value to be applied to the organic light emitting display panel, the compensation for the driving voltage EVDD or the base voltage EVSS causes the driving voltage EVDD or the base voltage EVSS having the desired voltage value to be applied to the organic light emitting display panel, and thereby a distortion phenomenon of the driving voltage EVDD or the base voltage EVSS caused by the coupling phenomenon of the driving voltage EVDD or the base voltage EVSS can be reduced, so that image quality can also be improved.

Figure 13:
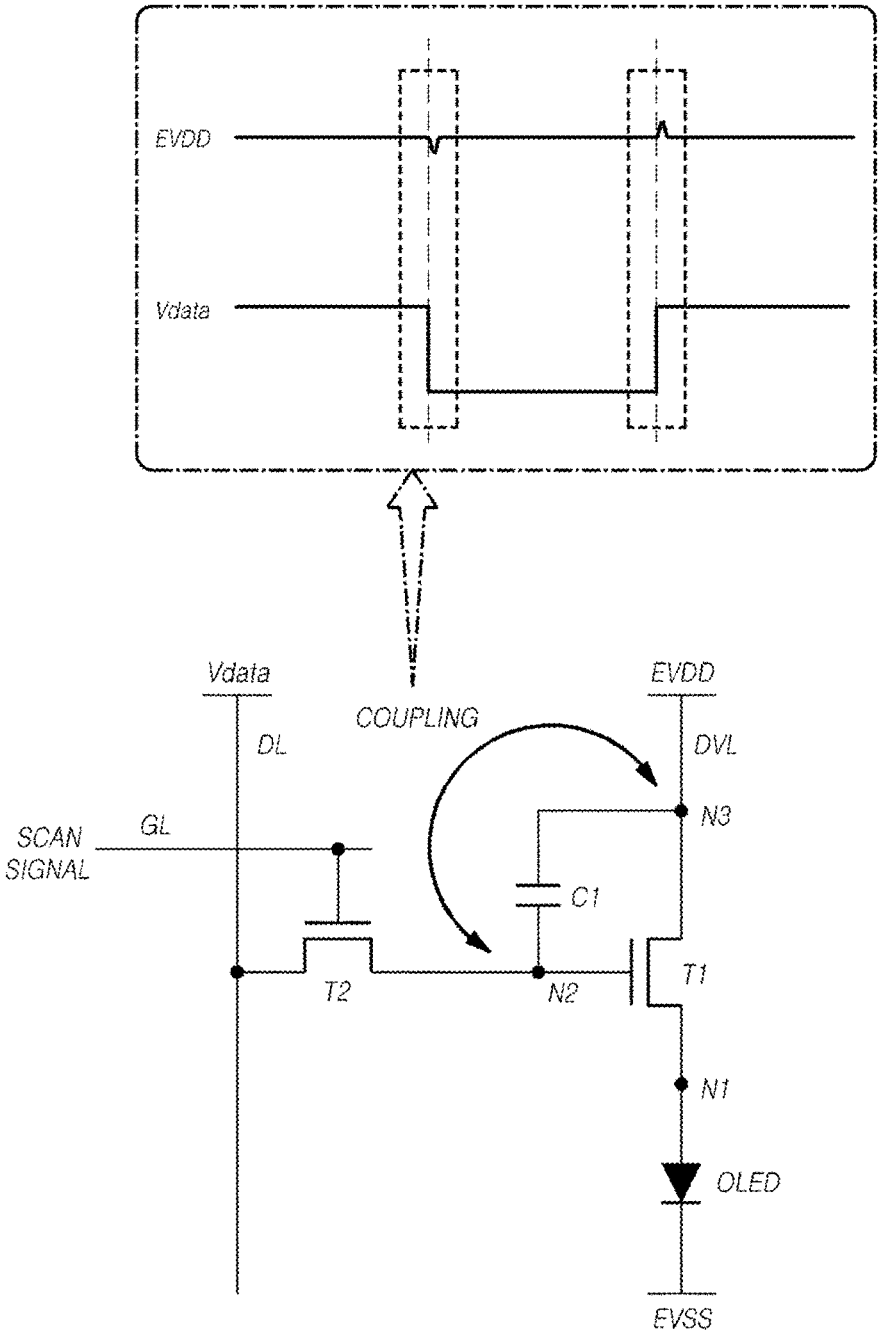
FIG. 13 is a view illustrating a driving voltage coupling phenomenon in another sub-pixel structure of a display device according to embodiments of the present disclosure.
Figure 14:
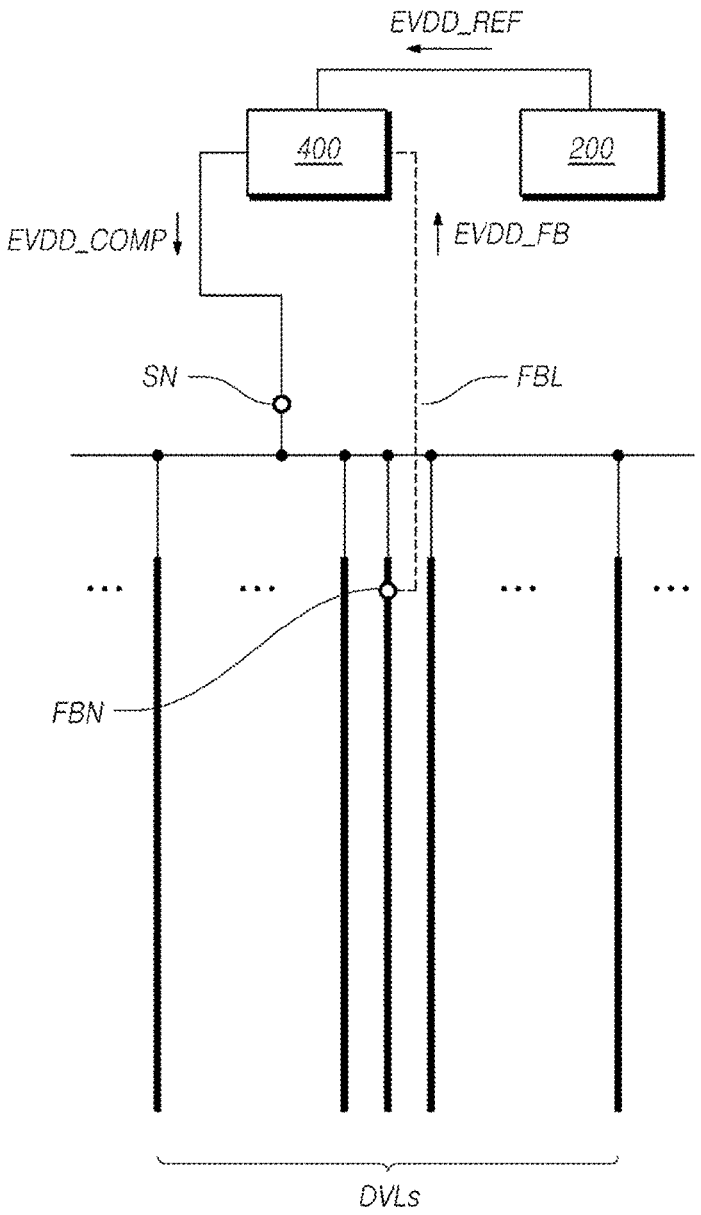
FIG. 14 is a view illustrating a common voltage compensation configuration for reducing a driving voltage distortion phenomenon caused by a driving voltage (EVDD) coupling phenomenon in a display device according to embodiments of the present disclosure.
Figure 15:
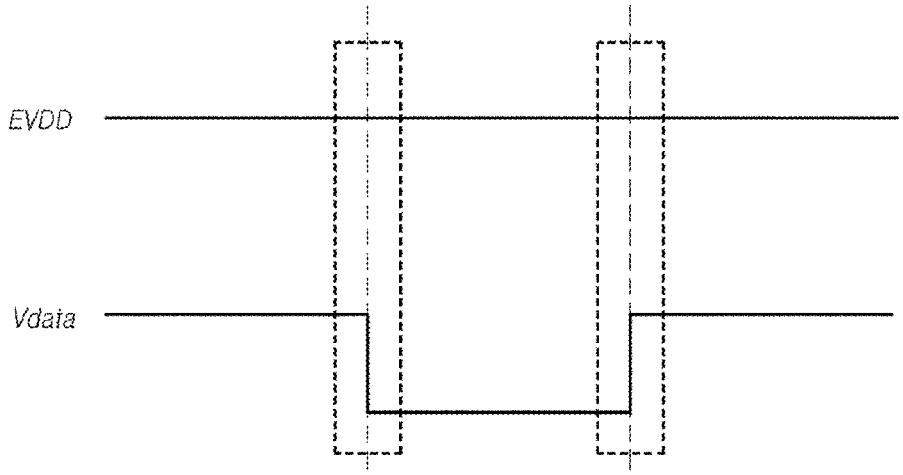
FIG. 15 is a view illustrating a reduction in a driving voltage coupling phenomenon and a driving voltage distortion phenomenon caused by the driving voltage coupling phenomenon, through compensation for a driving voltage in a display device according to embodiments of the present disclosure.

FIG. 13 is a view illustrating a driving voltage coupling phenomenon in another sub-pixel structure of a display device according to embodiments of the present disclosure. FIG. 14 is a view illustrating a common voltage compensation configuration for reducing a driving voltage distortion phenomenon caused by a driving voltage (EVDD) coupling phenomenon in the display device 100 according to embodiments of the present disclosure. FIG. 15 is a view illustrating a reduction in a driving voltage coupling phenomenon and a driving voltage distortion phenomenon caused by the driving voltage coupling phenomenon, through compensation for a driving voltage in the display device 100 according to embodiments of the present disclosure.

FIG. 13 is a circuit diagram illustrating an example of an equivalent circuit of a SP including two transistors T1 and T2, and one capacitor C1.

Referring to FIG. 13, each SP includes an OLED, a first transistor T1, a second transistor T2, and a first capacitor C1.

The first transistor T1 is a driving transistor that drives the OLED, and is connected between the OLED and a driving voltage line (DVL) or a pattern connected to the DVL.

In the first transistor T1, a second node N2 is a gate node, a first node N1 is a drain node or a source node, and a third node N3 is a source node or a drain node.

The second transistor T2 is a switching transistor that controls the turn on and turn off of the first transistor T1, and is connected between the second node (gate node) N2 of the first transistor T1 and a data line (DL).

The first capacitor C1 is connected between the first node N1 of the first transistor T1 and the third node N3 thereof, and serves as a storage capacitor that maintains a predetermined voltage during one frame.

Referring to FIG. 13, the turn on and turn off of the second transistor T2 is controlled by a scan signal supplied from a gate line (GL). When the second transistor T2 is turned on, the second transistor T2 applies a data voltage Vdata, which is supplied from a data line (DL), to the second node N2 of the first transistor T1.

Referring to FIG. 13, the data voltage Vdata and a driving voltage EVDD may be applied to both ends of the first capacitor C1.

Referring to FIG. 13, the driving voltage EVDD applied to one end of the first capacitor C1 is a kind of common voltage supplied to all of the SPs. Accordingly, the DVL corresponds to a CVL.

The CVL is adjacent to the DL.

Accordingly, when the data voltage Vdata supplied through the data lines rapidly changes, namely, when the data voltage Vdata changes from a high level to a low level or when the data voltage Vdata changes from the low level to the high level, a phenomenon may occur in which the driving voltage EVDD, which is applied through the DVLs adjacent to the data lines at a point where the data voltage Vdata rapidly changes, becomes smaller or larger than a desired voltage value.

Specifically, referring to FIG. 13, when the data voltage Vdata supplied through the data lines swings, a kickback phenomenon in the display panel 110 may cause a coupling phenomenon to occur to the driving voltage EVDD applied to the DVLs adjacent to the data lines.

The coupling phenomenon causes a charging characteristic of a capacitor C, to which the driving voltage EVDD is applied, to be non-uniform. The non-uniform charging characteristic may cause an image failure phenomenon, such as horizontal crosstalk and the like.

Referring to FIG. 14, the common voltage compensator 400 receives feedback of a driving voltage, which is actually applied to the display panel 110 (i.e., actually applied to DVLs), as a feedback driving voltage EVDD_FB through a FBL connected to a FBN on at least one DVL from among the DVLs.

Referring to FIG. 14, the common voltage compensator 400 outputs a compensation driving voltage EVDD_COMP to a SN on the basis of a reference driving voltage EVDD REF which is input from DVLs and the power controller 200.

Accordingly, the compensation driving voltage EVDD_COMP is applied to all of the DVLs electrically connected to the SN.

Therefore, a voltage, which is identical to the reference driving voltage EVDD REF desired to be applied to the display panel 110, is actually applied to the display panel 110, and thereby driving voltage compensation is achieved.

As described above, when a driving voltage EVDD having a different voltage value from a desired voltage value is applied to the organic light emitting display panel due to the coupling phenomenon of the driving voltage EVDD in the organic light emitting display panel, the compensation for the driving voltage EVDD causes the driving voltage EVDD having the desired voltage value to be applied to the organic light emitting display panel, and thereby the driving voltage distortion phenomenon caused by the driving voltage coupling phenomenon can be reduced, so that image quality can also be improved.

Referring to FIG. 15, when the above-described driving voltage compensation is applied, differently from FIG. 13, it can be noted that a phenomenon, in which a driving voltage EVDD is distorted, does not appear even at a point where a data voltage Vdata rapidly changes.

Figure 16:
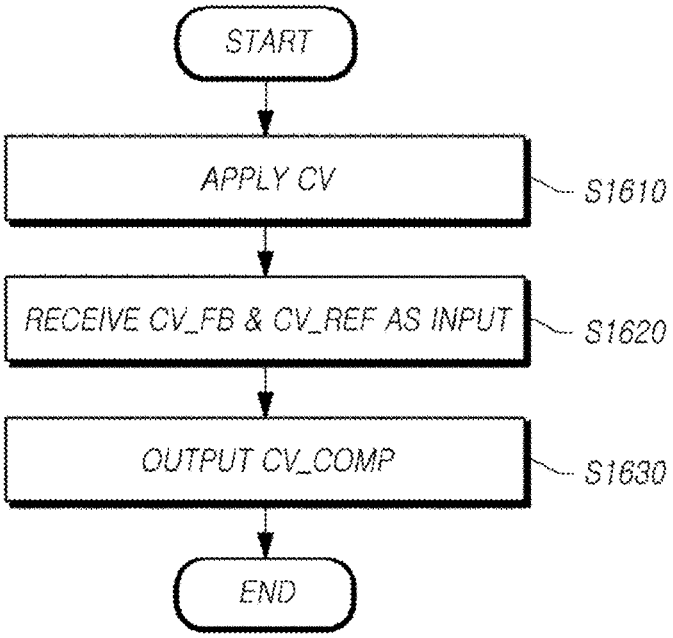
FIG. 16 is a flowchart illustrating a method for driving a display device according to embodiments of the present disclosure.

FIG. 16 is a flowchart illustrating a method for driving the display device 100 according to embodiments of the present disclosure.

Referring to FIG. 16, the method for driving the display device 100 according to embodiments of the present disclosure includes: step S1610 of applying a CV to the display panel 110 through CVLs; step S1620 of receiving, as input, a feedback CV CV_FB, which is feedback of the CV applied to the display panel 110, and a reference CV CV_REF; step S1630 of applying a compensation CV CV_COMP, which is obtained by compensating for the CV on the basis of the feedback CV CV_FB and the reference CV CV_REF, to the display panel 110 through the CVLs; and the like.

According to the above-described driving method, when a CV having a different voltage value from a desired voltage value (a reference CV) due to the coupling phenomenon is applied to the display panel 110, the compensation for the CV causes the CV having the desired voltage value to be applied to the display panel 110, and thereby the common voltage distortion phenomenon caused by the common voltage coupling phenomenon can be reduced, so that image quality can be also improved.

The above-described compensation CV CV_COMP is a voltage commonly applied to multiple SPs on the display panel 110, and is a voltage applied to one end of a capacitor within each SP.

For example, the compensation CV CV_COMP may be one of a compensation reference voltage Vref_COMP obtained by compensating for a reference voltage Vref applied to a source node or a drain node of a driving transistor within each SP, a compensation driving voltage EVDD_COMP obtained by compensating for a driving voltage EVDD supplied to a driving transistor within each SP, and a compensation base voltage EVSS_COMP obtained by compensating for a base voltage EVSS supplied to a cathode electrode or an anode electrode of an OLED within each SP.

The compensation CV CV_COMP is applied to one end of a capacitor C within each SP as described above, and thereby it is possible to prevent a charging characteristic of the capacitor C from becoming non-uniform, so that image quality can be improved.

Meanwhile, the above-described common voltage compensation may be identically applied to not only common voltage compensation in an OLED display device but also common voltage compensation in an LCD device.

Specifically, when the display device 100 is an LCD device, a CV applied to the display panel 110 may be applied to compensation for a common voltage Vcom applied to a common electrode that faces each pixel electrode.

The above-described embodiments of the present disclosure may provide the display device 100 and the method for driving the same, which reduce or prevent the common voltage distortion phenomenon caused by the coupling phenomenon and thereby improve image quality.

Also, the above-described embodiments of the present disclosure may provide the display device 100 and a method for driving the same, which reduce or prevent the reference voltage distortion phenomenon caused by the coupling phenomenon of the reference voltage (Vref) applied to the organic light emitting display panel and thereby improve image quality.

The above description and the accompanying drawings provide an example of the technical idea of the present invention for illustrative purposes only. Those having ordinary knowledge in the technical field, to which the present invention pertains, will appreciate that various modifications and changes in form, such as combination, separation, substitution, and change of a configuration, are possible without departing from the essential features of the present invention. Therefore, the embodiments disclosed in the present invention are intended to illustrate the scope of the technical idea of the present invention, and the scope of the present invention is not limited by the embodiment. The scope of the present invention shall be construed on the basis of the accompanying claims in such a manner that all of the technical ideas included within the scope equivalent to the claims belong to the present invention.

DESCRIPTION OF REFERENCE NUMERALS

100: Display device
110: Display panel
120: Data driver
130: Gate driver
140: Timing controller

What is claimed is:

1. A display device comprising:

a display panel having data lines, gate lines, and common voltage lines disposed therein, and having multiple sub-pixels disposed thereon;

a data driver for supplying a data voltage to the data lines; and a common voltage compensator for applying a compensation common voltage obtained by compensating for a common voltage based on a feedback common voltage, which is feedback of the common voltage applied to the display panel through the common voltage lines, and a reference common voltage, to the display panel through the common voltage lines, wherein the compensation common voltage corresponds to a voltage commonly applied to the multiple sub-pixels, and corresponds to a voltage applied to one end of a capacitor within each of the multiple sub-pixels, wherein each of the multiple sub-pixels includes:

an organic light emitting diode (OLED);

a first transistor connected between the OLED and a driving voltage line or a pattern connected to the driving voltage line;

a second transistor connected between a second node of the first transistor and the data line;

a third transistor connected between a first node of the first transistor and a reference voltage line or a pattern connected to reference voltage line; and the capacitor connected between the first node of the first transistor and the second node thereof, wherein the reference voltage line corresponds to the common voltage line for supplying a compensation reference voltage corresponding to the compensation common voltage, and the third transistor is turned on and applies the compensation reference voltage, which is supplied through the reference voltage line, to the first node of the first transistor and one end of the capacitor.

2. The display device of claim 1, wherein the common voltage compensator receives the reference common voltage as input from a power controller, receives the feedback common voltage as input through a feedback line connected to at least one of the common voltage lines, and applies the compensation common voltage to the common voltage lines through a supply node.

3. The display device of claim 2, wherein the common voltage compensator comprises:

a difference voltage output unit having a first input terminal for receiving the reference common voltage as input from the power controller, a second input terminal for receiving the feedback common voltage as input from the feedback line, and an output terminal for outputting a difference voltage between the reference common voltage and the feedback common voltage; and a compensation common voltage output unit for outputting the compensation common voltage based on the reference common voltage and the difference voltage, and applying the compensation common voltage to the common voltage lines through the supply node.

4. The display device of claim 1, wherein the common voltage compensator comprises an operational amplifier (op-amp) circuit.

5. The display device of claim 1, wherein the common voltage compensator is included in a source driver integrated circuit of the data driver.

6. The display device of claim 1, wherein the common voltage compensator comprises a circuit implemented on a printed circuit board.

7. The display device of claim 1, wherein the compensation common voltage comprises one of:

a compensation reference voltage obtained by compensating for a reference voltage applied to a source node or a drain node of a driving transistor within the each sub-pixel;

a compensation driving voltage obtained by compensating for a driving voltage supplied to the driving transistor within the each sub-pixel; and a compensation base voltage obtained by compensating for a base voltage supplied to a cathode electrode or an anode electrode of an organic light emitting diode within the each sub-pixel.

8. A method for driving a display device, the method comprising:

applying a common voltage to anodes of organic light emitting diodes (OLEDs) included in sub-pixels of a display panel through common voltage lines;

receiving, a reference common voltage and a feedback common voltage that is feedback of the common voltage applied to the display panel; and applying a compensation common voltage to the anodes of the OLEDs through the common voltage lines, the compensation common voltage obtained by compensating for the common voltage based on the feedback common voltage and the reference common voltage.

9. The method of claim 8, wherein the compensation common voltage corresponds to a voltage commonly applied to multiple sub-pixels on the display panel, and corresponds to a voltage applied to one end of a capacitor within each of the multiple sub-pixels.

10. A display device comprising:

a display panel having data lines, gate lines, and common voltage lines disposed therein, and having multiple sub-pixels disposed thereon, each of the multiple sub-pixels including:

an organic light emitting diode (OLED);

a first transistor including a first electrode, a second electrode, and a third electrode, the first electrode of the first transistor connected to a driving voltage line or a pattern connected to the driving voltage line, and the second electrode of the first transistor connected to an anode of the OLED;

a second transistor including a first electrode, a second electrode, and a third electrode, the first electrode of the second transistor connected to one of the data lines, and the second electrode of the second transistor connected to the third electrode of the first transistor, and the third electrode of the second transistor connected to one of the gate lines;

a third transistor including a first electrode, a second electrode, and a third electrode, the first electrode of the third transistor connected to the anode of the OLED and the second electrode of the first transistor, and the second electrode of the third transistor connected to one of the common voltage lines or a pattern connected to the common voltage line line; and a capacitor including a first end and a second end, the first end of the capacitor connected to the second electrode of the second transistor and the third electrode of the first transistor, and the second end of the capacitor connected to the second end of the first transistor, the anode of the OLED, and the first electrode of the third transistor;

a data driver for supplying a data voltage to the data lines; and a common voltage compensator for applying a compensation common voltage to the anode electrodes of the OLEDs included in the multiple sub-pixels via the third transistors that are connected to the common voltage lines, the compensation common voltage compensating for a common voltage applied to the anode electrodes of the OLEDs that deviates from a desired voltage, the compensation common voltage obtained based on a feedback common voltage and a reference common voltage, wherein the feedback common voltage is feedback of the common voltage applied to the anodes of the OLEDs through the common voltage lines.

* * * * *